United States Patent [19]

Molyneux

[11] Patent Number: 4,821,957

[45] Date of Patent: Apr. 18, 1989

[54] RESILIENT MATERIAL HOUSING IN THE NOSE OF A RAIL ANCHORAGE

[76] Inventor: Godfrey M. O. Molyneux, "Burway", Rudford, Gloucester, England, GL2 8DY

[21] Appl. No.: 107,385

[22] Filed: Oct. 9, 1987

[30] Foreign Application Priority Data

Oct. 13, 1986 [GB] United Kingdom ..... 8624468

[51] Int. Cl.[4] ..... E01B 9/00

[52] U.S. Cl. ..... 238/317; 238/361

[58] Field of Search ..... 238/317, 315, 361

[56] References Cited

U.S. PATENT DOCUMENTS 3,028,099 4/1962 Molyneux ..... 238/317

FOREIGN PATENT DOCUMENTS 139650 3/1953 Sweden ..... 238/317

*Primary Examiner*—A. Michael Chambers

*Attorney, Agent, or Firm*—Marshall, O'Toole, Gerstein, Murray & Bicknell

[57] ABSTRACT

A rail anchorage has a housing in which is received resilient material for bearing on the flange of a rail that the anchorage is to secure. The housing is formed to exert a wedging action on the resilient material when the material bears on the flange, and preferably also when the material is otherwise unloaded. In use the wedging action increases as the force placed on the resilient member increases.

9 Claims, 3 Drawing Sheets

RESILIENT MATERIAL HOUSING IN THE NOSE OF A RAIL ANCHORAGE

FIELD AND BACKGROUND OF THE INVENTION

This invention relates to rail anchorages which are used with all rails, but is particularly concerned with anchorages for use with rails used by cranes. With certain heavy-duty cranes as they accelerate and brake, the rails if unrestrained tend to shut or slide backwards or forwards in the direction along their length. Such longitudinal sliding of the rail is also caused by the rolling action exerted on the rail ahead of metal crane wheels as the crane travels the rail. This sliding action produces wear and grooving of the metal support structure to which the anchorages are secured and upon which the rail rests.

In the prior art resilient material has been vulcanized on to the underside of the part (the so-called "nose") of the rail anchorage that overhangs the rail flange. This is a relatively expensive process. Alternatively, resilient material has been placed in a pocket with parallel sides in the rail anchorage.

SUMMARY OF THE INVENTION

The invention provides a rail anchorage having a housing in which there is received resilient material for bearing on the flange of a rail that the anchorage is to secure, the housing being forced to exert a wedging action on the resilient material when the material bears on the rail flange. In a prefered form the wedging action is also provided when the resilient material is otherwise unloaded. By the provision of the resilient material in the housing, excessive fatiguing stresses are not transmitted to a stud or bolt to which the anchorage is secured to be made fast wtih a support structure for the rail, and by the wedging action the resilient material is trapped in place. This trapping effect increasing as the force placed on the resilient material increases. Whilst achieving this wedging action, the resilient material is also given space into which it can expand, thus reducing the stress that would otherwise be transmitted to the rail anchorage as the rail rises with the rolling action of a crane travelling thereon. The resilient material increases its grip on the rail flange as the rolling action increases.

BRIEF DESCRIPTION OF THE DRAWINGS

The invention will be better understood from the following detailed description taken in conjunction with the accompanying Figures of the drawings, wherein.

DETAILED DESCRIPTION OF THE DRAWINGS

Figure 1:
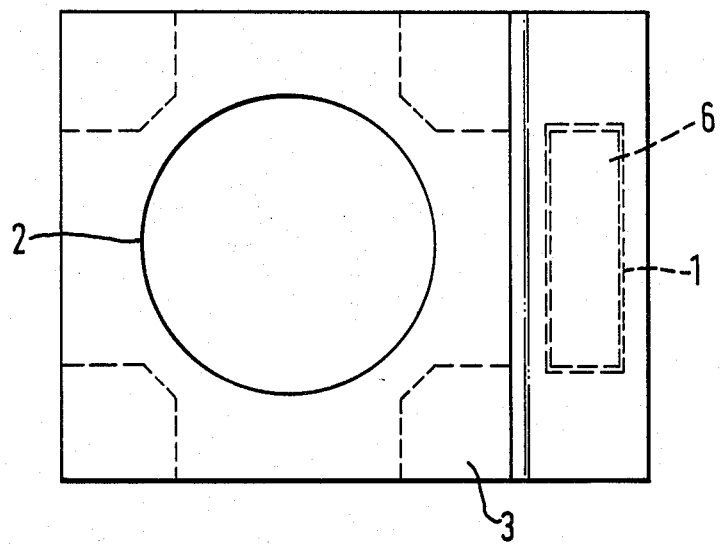
FIG. 1 is a plan view of a rail anchorage.
Figure 2:
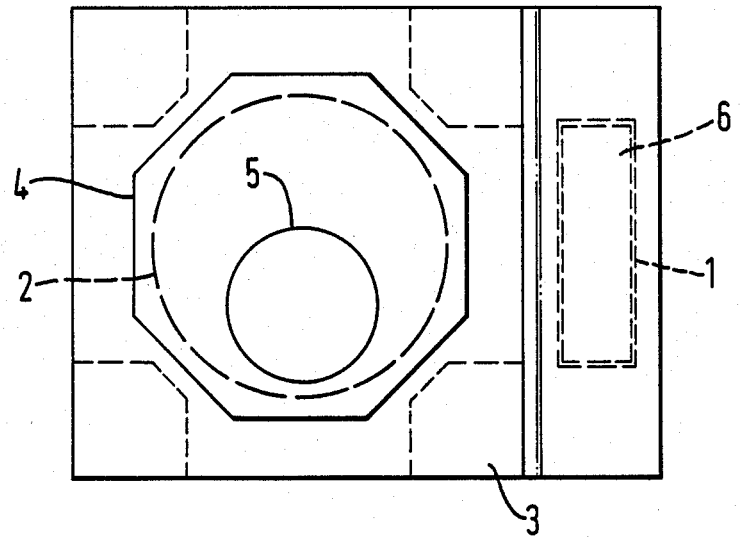
FIG. 2 is a plan view of the rail anchorage of FIG. 1 with a rotary cam mounted therein.
Figure 3:
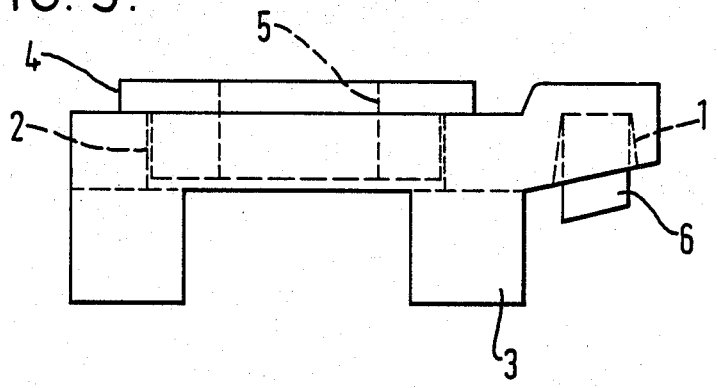
FIG. 3 is a side view of the anchorage as shown in FIG. 2.
Figure 4:
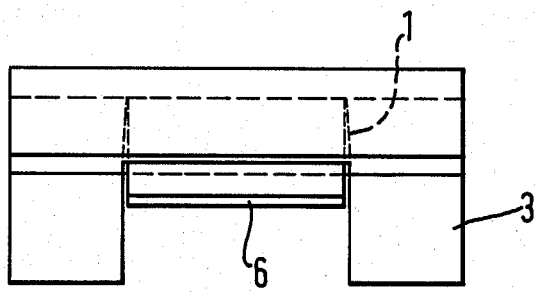
FIG. 4 is a front view of the anchorage.

Referring first to FIGS. 1, 3 and 4, the rail anchorage has a housing in the form of an enclosure or pocket 1 in its nose portion in which is received a strip of resilient material 6. The anchorage also has a large aperture 2 which receives a cam 4 as shown in FIG. 2. The cam 4 has an eccentric hole 5 for receiving a locating member that is a screw-threaded bolt or stud. When the cam is rotated in the aperture, the anchorage moves relative to the rail it is to secure and relative to the bolt or stud.

Figure 5:
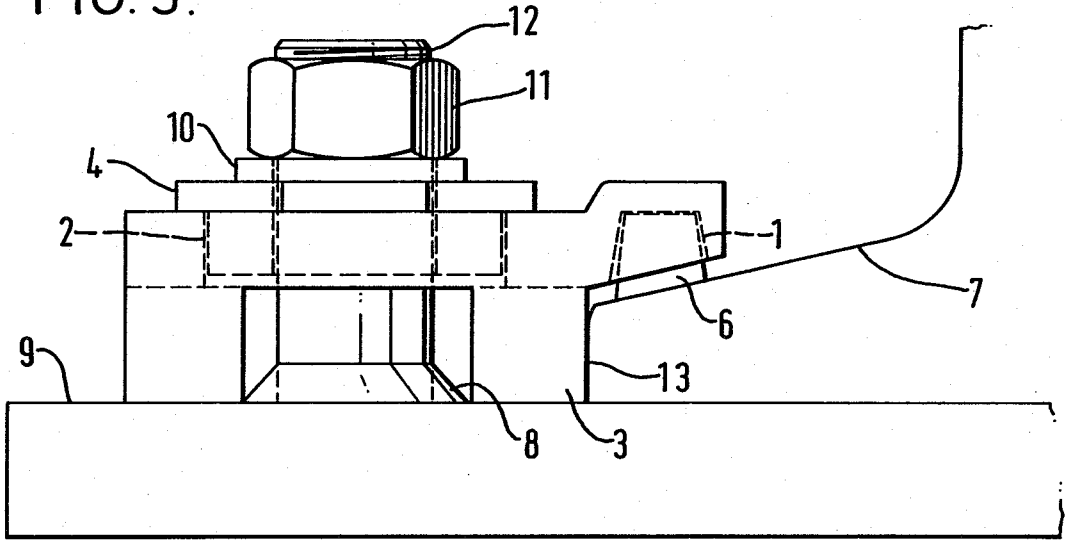
FIG. 5 is a side view of the anchorage shown secured to a support structure and securing a rail to the structure.

As shown in FIG. 5, in use the anchorage is fitted over a screw-threaded stud 12 welded, at 8, to the rail support structure 9. Alternatively the anchorage could be fitted over a screw-threaded bolt secured to the support structure.

The stud 12 passes through the eccentric hole 5 in the cam 4. Above the anchorage there are a washer 10 and a nut 11 on the stud 12, the nut 11 being tightened down on a screw-threaded portion of the stud to secure the anchorage relative to the stud and a rail flange 7. The resilient material 6 is partially compressed within the enclosure 1 over the rail flange 7. Legs 3 of the anchorage abut the support structure with the front legs against the toe 13 of the rail flange 7.

As can be seen from the Figures there is weding action applied to the resilient material 6 by the inner surfaces of the enclosure 1. To this end at least one internal surface of the enclosure 1 is inclined so that when the strip of resilient material 6 is inserted into the enclosure it is wedged in place. The exertion of a wedging action when the resilient material is otherwise unloaded facilitates installing the anchorage, with the resilient material pre-fitted, against the rail. However, the wedging action on the resilient material may take place only when the anchorage is installed on the rail support structure and the resilient material is bearing on the rail flange. Initial compression forces the resilient material into the enclosure and causes expansion against the surfaces of the enclosure.

As the nut 11 is tightened down, the compression of the resilient material increases and so does the wedging action that holds it in place. When the crane travels the rail, the rolling action ahead of the crane wheels tends to cause the rail to rise and slide in the direction along its length. However, the more severe the rolling action, the greater is the frictional resistance from the resilient material and the greater is the wedging action on the resilient material in its enclosure, acting to prevent displacement of the resilient material and hence also acting to prevent longitudinal sliding of the rail. Nevertheless, since the resilient material is free to expand into and against the sides of its enclosure, the stress placed on the anchorage is minimized as vertical movement of the rail is resisted generally by the ability of the resilient material to compress freely. This is also aided by the front feet of the anchorage resting on the support structure. The anchorage does not move vertically with the movement of the rail. Such action would, with a heavy-duty crane, create excessive fatigue stress in the welded stud that fixes the anchorage in place. However, excessive movement of the rail is controlled since compression of the resilient material is limited by the size of the enclosure relative to the resilient material and the height of the nose of the anchorage which overhangs the rail flange.

The housing holding the resilient material does not have to be a complete enclosure or have continuous surfaces to perform its function. The resilient material only requires to be confined to prevent its displacement. This can be achieved by non-continuous surfaces.

It is to be noted that the overall height of the anchorage is minimized. This is achieved by providing that the metal surrounding the enclosure rises above the upper surface of the central part of the anchorage, defining a central recess to receive the head of the cam 4. This also allows the lateral forces from the rail to be transmitted to the welded stud at a low position which has a beneficial effect on the strength of the anchorage to resist lateral loads.

The provision of the resilient material in an enclosure is particularly suited to the laterally adjustable rail anchorage that has been described. Because such a rail anchorage is not fixed in one position, but can move laterally relative to the bolt ot stud that locates it and relative to the rail, the anchorage can always be hard against the rail toe and consequently the resilient material is always in the same position relative to the sloping surface of the rail flange. Therefore, the force the resilient material applies to the rail flange is substantially constant for each rail anchorage.

What is claimed is:

1. A rail anchorage having a housing in which there is received a resilient member for bearing on the flange of a rail that the anchorage is to secure, the housing being formed with a pocket portion having sides which receives said resilient member, said resilient member having sides which are adjacent said sides of said pocket portion, said sides of one of said resilient member and said pocket portion being inclined whereby there is produced a wedging action on the resilient member during use of the rail anchorage when the member bears on the rail flange.

2. A rail anchorage according to claim 1, wherein the sides of said pocket portion are inclined to exert a wedging action on the resilient member when the member is otherwise unloaded.

3. A rail anchorage arrangement comprising a locating member fast with a rail support structure, and a rail anchorage made fast to the locating member and having a housing in which is received a resilient member for bearing on the flange of a rail that the anchorage is to secure, the housing being formed with a pocket portion having sides which receives said resilient member, said resilient member having sides which are adjacent said sides of said pocket portion, said sides of one of said resilient member and said pocket portion being inclined whereby there is produced a wedging action on the resilient member during use of the rail anchorage when the member bears on the rail flange.

4. A rail anchorage arrangement according to claim 3, wherein the sides of said pocket portion are inclined to exert a wedging action on the resilient member when the member is otherwise unloaded.

5. A rail anchorage arrangement according to claim 3 or 4, wherein the rail anchorage is apertured to receive the locating member and includes a rotary cam which has an eccentric hole through which the locating member passes, the cam being rotatable to act on the locating member tightly to fit the anchorage against a rail.

6. A rail anchorage for use with a rail including a flange, the flange being attached to a rail support structure, said rail anchorage comprising a housing adapted to be mounted on said rail support structure adjacent said flange, said housing including a portion which is adapted to extend over said flange, said portion having a pocket formed therein, and resilient means mounted in said pocket and wedged between said portion and said flange, the adjacent sides of said pocket and said resilient means forming tapered openings for receiving expansion of said resilient means when said resilient means is under load from said flange.

7. A rail anchorage as set out in claim 6, wherein the sides of said pocket are tapered and the adjacnet sides of said resilient means are square.

8. A rail anchorage as set out in claim 7, wherein said resilient means has a bottom side which is engageable with the upper surface of said flange, and said bottom side is slanted.

9. A rail anchorage as set out in claim 6, and further including eccentric means between said housing and the rail support structure, said eccentric means being adjustable to move said housing toward and away from the rail.

* * * * *